United States Patent [19]

Yanagishima et al.

[11] 4,348,663

[45] Sep. 7, 1982

[54] SAFETY ASSURANCE SYSTEM FOR ROAD VEHICLES

[75] Inventors: Takayuki Yanagishima, Yokosuka; Yasutoshi Seko, Yokohama, both of Japan

[73] Assignee: Nissan Motor Company, Limited, Kanagawa, Japan

[21] Appl. No.: 181,654

[22] Filed: Aug. 26, 1980

[30] Foreign Application Priority Data

Aug. 29, 1979 [JP] Japan ..... 54-109199

[51] Int. Cl.[3] ..... G08B 21/00

[52] U.S. Cl. ..... 340/576; 180/272

[58] Field of Search ..... 340/576, 575; 180/272

[56] References Cited

U.S. PATENT DOCUMENTS 3,611,344 10/1971 Couper ..... 180/272
3,922,665 11/1975 Curry et al. ..... 180/272
4,031,527 6/1977 Yanagashima et al. ..... 340/576
4,196,412 4/1980 Sluis et al. ..... 340/575

*Primary Examiner*—Glen R. Swann, III
*Attorney, Agent, or Firm*—Lowe, King, Price & Becker

[57] ABSTRACT

A safety assurance system is disclosed for use in road vehicles. The system comprises a generator for providing a warning signal in response to a predetermined condition such as dozing of the driver. A rest signal is generated when the road vehicle is at rest, and a reset switch enables the driver to manually provide a reset signal. A first alarm signal is provided which is generated in response to the warning signal until the rest signal is generated. Also provided is a second signal which is generated in response to the warning signal until the rest signal or reset signal is generated. Thus, warning signals are generated that are terminated automatically when the vehicle comes to a stop or are terminated by manual operation of a reset signal.

11 Claims, 5 Drawing Figures

SAFETY ASSURANCE SYSTEM FOR ROAD VEHICLES

BACKGROUND OF THE INVENTION

Field of the Invention

This invention relates to a safety assurance system for use in a road vehicle and, more particularly, to such a system adapted to make an alarm so as to bring the driver to his senses if the driver falls into a doze or fatigued condition during driving the vehicle.

Description of the Prior Art

Such safety assurance systems have already been proposed which are adapted to give an alarm in order to bring the driver to his senses if the driver falls into a doze or fatigued condition during driving a road vehicle. One difficulty with such conventional safety assurance systems is that their arousing effect becomes too low after long alarming to prevent the driver from falling again into a doze. In addition, the driver can reset the alarm and completely invalidate the alarming without his senses.

SUMMARY OF THE INVENTION

It is therefore one object of the present invention to provide an improved safety assurance system for use in road vehicles which is free from the above described disadvantages found in conventional systems.

BRIEF DESCRIPTION OF THE DRAWINGS

The present invention will be described in greater detail by reference to the following description taken in connection with the accompanying drawings, in which.

DESCRIPTION OF THE PREFERRED EMBODIMENTS

Figure 1:
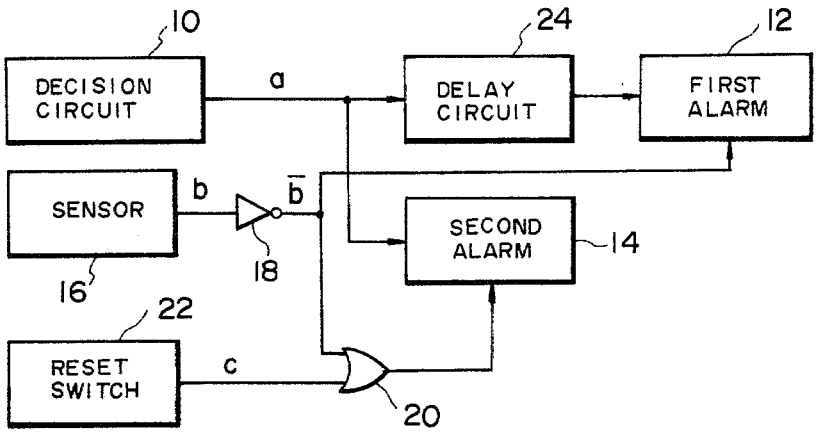
FIG. 1 is a block diagram showing one embodiment of the safety assurance system made in accordance with the present invention.

Referring now to FIG. 1, there is illustrated one embodiment of a safety assurance system made in accordance with the present invention. The safety assurance system is illustrated as including a decision circuit 10 which is adapted to make a decision whether or not the driver is in a doze or fatigued condition in accordance with vehicle running conditions. If there is any driver's doze or fatigued condition, the decision circuit 10 provides a warning signal a at its output. An example of appropriate decision circuits that may be used is shown and described in U.S. Pat. No. 3,877,541 issued on Apr. 15, 1975 is adapted to detect a driver's doze or fatigued condition in accordance with the oscillations of the steering wheel of a vehicle.

The output of the decision circuit 10 is coupled to first alarm means 12 and also to second alarm means 14. The first alarm means 12 is for urging the driver to rest from driving by giving various audible or visible signals, such as sounding a buzzer, flashing a light, etc. The second alarm means 14 is for bringing the driver to his senses by blowing a pulsated air stream from an air-conditioner to the driver, sounding a buzzer, etc.

The safety assurance system also includes a sensor 16 which is adapted to determine whether the road vehicle runs or rests. The sensor 16 provides at its output a run signal b when the road vehicle is running. The sensor 16 may be arranged to provide a run signal in accordance with a signal from a vehicle speed sensor or a tape switch set on the dashboard. The output of the sensor 16 is coupled to the input of an inverter 18. The output of the inverter 18 is connected to the reset terminal of the first alarm means 12 and also to one input of an OR gate 20, the output of which is coupled to the reset terminal of the second alarm means 14. The other input of the OR gate 20 is connected toareset switch 22 which is manually operated, by the driver, to provide a reset signal c through the OR gate 20 to the reset terminal of the second alarm means 14 if there is a need to reset the second alarm means 14.

The operation of the safety assurance system of the present invention will now be described with reference to the timing chart of FIG. 5.

Figure 5:
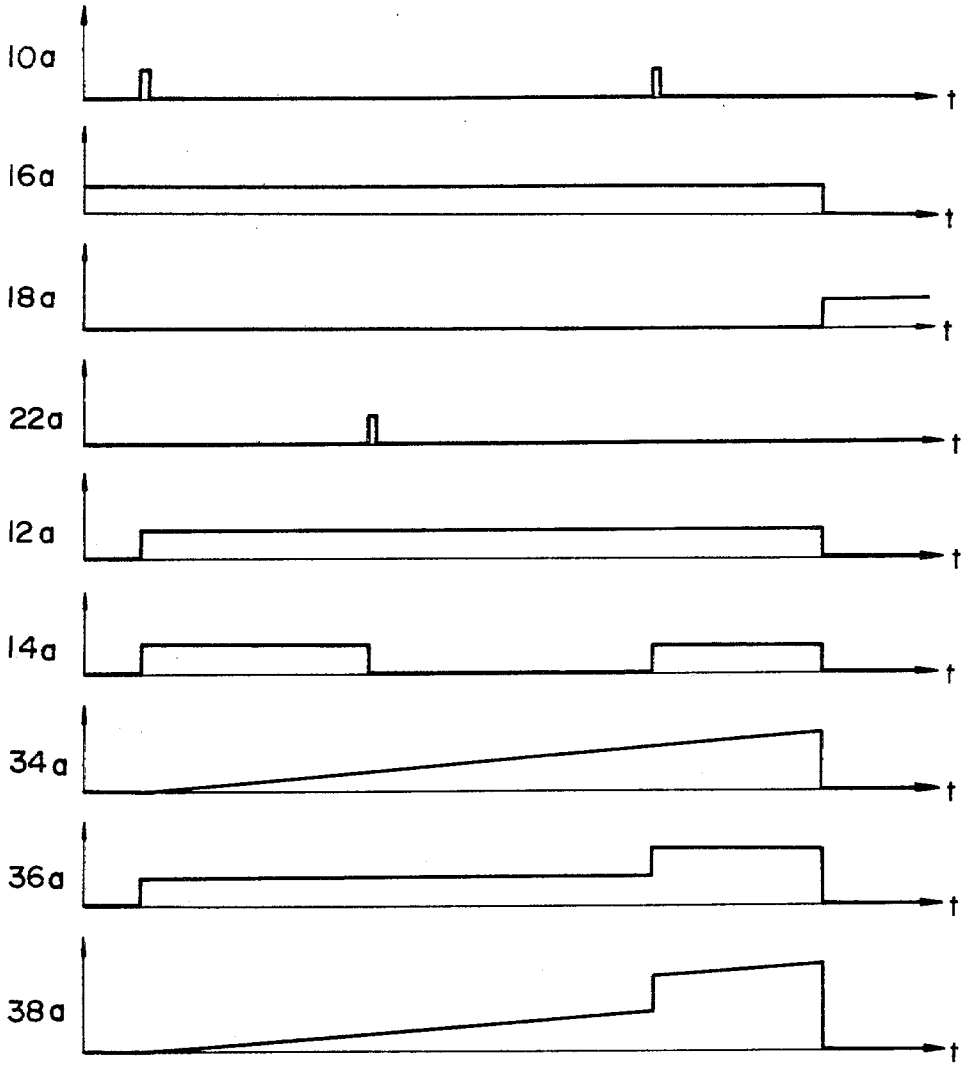
FIG. 5 is a timing chart used in explaining the operation of the safety assurance system of the present invention.

When the driver drives the road vehicle in a doze or fatigued condition, the decision circuit 10 generates a warning signal a, which is shown as a high level in waveform 10*a* of FIG. 5, causing the first and second alarm means 12 and 14 to start giving an alarm, as seen in waveforms 12*a* and 14*a* of FIG. 5. If the driver comes into his senses by the alarm and operates the reset switch 22, a reset signal c, which is shown as a high level in waveform 22*a* of FIG. 5, is applied through the OR gate 20 to the reset terminal of the second alarm means 14. This resets the second alarm means 14, as seen in waveform 14*a* of FIG. 5, while the first alarm means 12 remains making an alarm, as seen in waveform 12*a* of FIG. 5, until the driver brings the road vehicle to rest.

If the road vehicle rests, then the sensor 16 stops the generation of the run signal b, which is shown as a high level is waveform 16*a* of FIG. 5, and the inverter 18 provides a rest signal $\bar{b}$, which is shown as a high level in waveform 18*a* of FIG. 5, directly to the first alarm means 12 which thereby is reset, as seen in waveform 12*a* of FIG. 5, and also through the OR gate 20 to the second alarm means 14 which thereby is reset if it is still in operation.

If the driver continues driving the road vehicle in spite of the alarm, then the decision circuit 10 provides an additional warning signal a, as seen in waveform 10*a* of FIG. 5, to the second alarm means 14 which thereby starts making an alarm again, as seen in waveform 14*a* of FIG. 5. The first alarm means 12 gives the alarm continuously, as seen in waveform 12*a* of FIG. 5.

As shown in FIG. 1, a delay circuit 24 may be provided between the first alarm means 12 and the decision circuit 10 for delaying the start of operation of the first alarm means 12 a predetermined time with respect to the start of operation of the second alarm means 14. The delay circuit 24 is optional.

Figure 2:
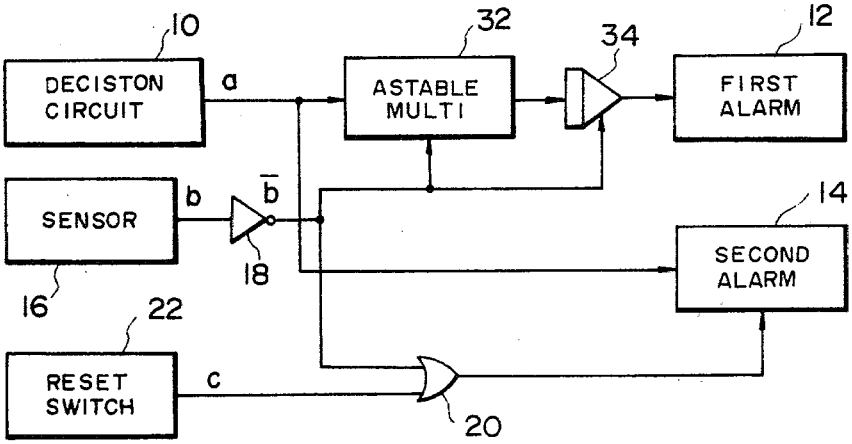
FIGS. 2 to 4 are block diagrams showing several additional embodiments of the present invention.

Referring to FIG. 2, there is illustrated a second embodiment of the present invention which is substantially similar to the first embodiment except that an additional circuit is provided for intensifying the alarm provided by the first alarm means 12 in accordance with the time elapsed after the start of generation of the alarm in order to urge the driver to rest from driving with higher reliability.

The circuit includes an astable multivibrator 32 which has an input from the decision circuit 10 and a reset terminal connected to the output of the inverter 18. The output of the astable multivibrator 32 is connected to the input of an integrating circuit 34 which has a reset terminal connected to the output of the inverter 18. The integrator circuit 34 integrates the signal from the astable multivibrator 32 with time. The integrated signal is coupled to the input of the first alarm means 12.

It can be seen from waveform 34*a* of FIG. 5 that the output of the integrating circuit 34 increases with the time lapse after the decision circuit 10 provides a warning signal a first. For example, if the first alarm means 12 utilizes a buzzer, this increases the volume of the buzzer sound with time so as to strongly urge the driver to rest from driving.

When the driver brings the road vehicle to rest, the sensor 16 stops the generation of the run signal b and the inverter 18 provides a rest signal $\overline{b}$, as seen in waveform 18*a* of FIG. 5, to render the astable multivibrator 32 out of operation and also reset the integrating circuit 34, thereby stopping the operation of the first alarm means 12.

Figure 3:
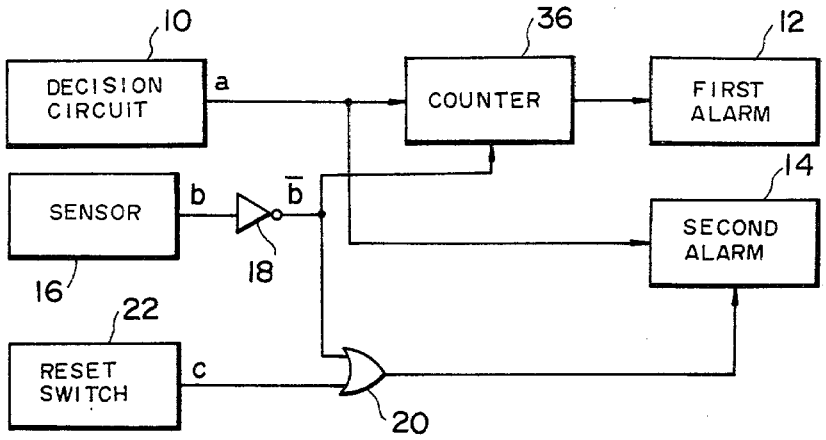

Referring to FIG. 3, there is illustrated a third embodiment of the present invention which is substantially similar to the first embodiment except that a counter 36 is provided prior to the first alarm means 12 for intensifying the alarm provided by the first alarm means 12 in accordance with the accumulative frequency of generation of warning signals a.

The counter 36 has an input from the decision circuit 10 and counts the number of warning signals a produced by the decision circuit 10. The counter 36 provides, to the first alarm means 12, an output signal which corresponds to the count stored in the counter 36 and thus increases by a step each time a warning signal a occurs, as seen in waveform 36*a* of FIG. 5. As a result, the alarm provided by the first alarm means 12 increases in steps in accordance with the accmulative frequency of production of warning signals a. For example, if the first alarm means 12 utilizes a buzzer, the volume of the buzzer sound increases in steps as the accumulative frequency of occurrence of warning signals a increases.

The counter 36 has its reset terminal connected to the output of the inverter 18. When the driver brings the road vehicle to rest, the sensor 16 stops generating the run signal $\overline{b}$, as seen in waveform 16*a* of FIG. 5, and the inverter 18 starts providing a rest signal b, as seen in waveform 18*a* of FIG. 5, to the counter 36 and also through the OR gate 20 to the second alarm means 14. As a result, the counter 36 is reset, as seen in waveform 36*a* of FIG. 5, to render the first alarm means 12 imoperative, as seen in waveform 12*a* of FIG. 5, and also the second alarm means 14 is reset, as seen in waveform 14*a* of FIG. 5.

Figure 4:
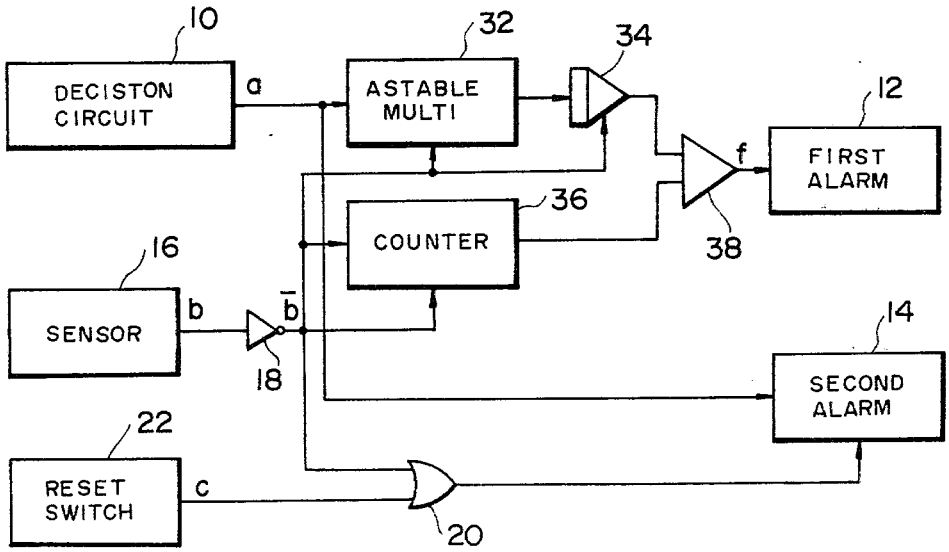

Referring to FIG. 4, there is illustrated a fourth embodiment of the present invention which is substantially similar to the first embodiment except that the combination of an astable multivibrator 32 and an integrating circuit 34 such as one described in connection with the second embodiment and a counter 36 such as one described in connection with the third embodiment is connected through an adder 38 to the first alarm means 12. With this embodiment, the first alarm means 12 receives, from the adder 38, a signal, as seen in waveform 38*a* of FIG. 5, which corresponds to the sum of the output signal from the integrating circuit 34, as seen in waveform 34*a* of FIG. 5, and the output signal from the counter 36, as seen in waveform 36*a* of FIG. 5.

Accordingly, the alarm produced by the first alarm means 12 is intensified in accordance with the time lapse and also with the accumulative frequency of occurrence of warning signals a. That is, the first alarm means 12 starts giving an alarm at the time when the first warning signal a is generated by the decision circuit 10 and increases the intensity of the alarm steplessly with time. When the second warning signal a occurs, the intensity of the alarm further increases in a step and thereafter increases steplessly with time. Such an alarm continues until the driver brings the road vehicle to rest.

The operation of the other components will be apparent from the foregoing and will not be described further.

The above described safety assurance system of the present invention includes first alarm means adapted to continue making an alarm until the driver bring the road vehicle to rest and second alarm means adapted to be reset by the driver. The driver is brought to his senses by the second alarm means and urged to rest from driving by the first alarm means. This is highly effective to improve the safety of driving.

The invention also enables the driver to be urged to rest from driving with higher reliability by increasing the intensity of the alarm made by the first alarm means in accordance with the time lapse after the first warning signal occurs and/or with the accumulative frequency of occurrence of warning signals.

It is to be noted that the decision circuit 10 may be removed and replaced with a manually operable switch adapted to be turned on to provide a warning signal where necessary.

While the present invention has been described in conjunction with specific embodiments thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. A system for use in a road vehicle, comprising:

(a) means for providing a warning signal;

(b) means for providing a rest signal when said road vehicle is at rest;

(c) means for providing a reset signal;

(d) first alarm means responsive to the warning signal for making an alarm until receiving the rest signal; and (e) second alarm means responsive to the warning signal for making an alarm until receiving the rest signal or reset signal.

2. A system according to claim 1, which further comprises a delay circuit provided between said first alarm means and said warning signal providing means for delaying the start of operation of said first alarm means a predetermined time with respect to the start of operation of said second alarm means.

3. A system according to claim 1, which further comprises a circuit for intensifying the alarm given by said first alarm means in accordance with the time lapse after a warning signal occurs.

4. A system according to claim 3, wherein said circuit comprises an astable multivibrator responsive to the warning signal for starting its operation, said astable multivibrator being reset in response to the rest signal, an integrator having its input coupled to said astable multivibrator for integrating the output thereof and having its output coupled to said first alarm means, and said integrator being reset in response to the rest signal.

5. A system according to claim 1, wherein said warning signal means is adapted to provide a warning signal in response to a driver's dozing or fatigued condition.

6. A system according to claim 5, which further comprises a circuit for intensifying the alarm given by said first alarm means in accordance with the time lapse after a warning signal occurs.

7. A system according to claim 6, wherein said circuit comprises an astable multivibrator responsive to the warning signal for starting its operation, said astable multi-vibrator being reset in response to the rest signal, an integrator having its input coupled to said astable multi-vibrator for integrating the output thereof and having its output coupled to said first alarm means, and said integrator being reset in response to the rest signal.

8. A system according to claim 5, which further comprises a circuit for increasing the intensity of the alarm given by said first alarm means in accordance with the accumulative frequency of occurrence of warning signals.

9. A system according to claim 8, wherein said circuit comprises a counter for counting the number of said warning signals, the output of said counter being coupled to said first alarm means, said counter being reset in response to the rest signal.

10. A system according to claim 5, which further comprises a circuit for increasing the intensity of the alarm given by said first alarm means in accordance with the time lapse after the first warning signal occurs and also with the accumulative frequency of occurrence of the warning signals.

11. A system according to claim 10, wherein said circuit comprises an astable multivibrator starting its operation in response to the rest signal, an integrator for integrating the output of said astable multi-vibrator, said integrator being reset in response to the rest signal, and a counter for counting the number of said warning signals, the output of said counter and of said integrator being coupled to said first alarm means, said counter and said integrator being reset in response to the rest signal.

* * * * *